US007712417B1

(12) United States Patent
Einstein et al.

(10) Patent No.: US 7,712,417 B1
(45) Date of Patent: May 11, 2010

(54) AXIAL MODULAR PROPULSION CHARGE DESIGN FOR SEMI-FIXED AMMUNITION

(75) Inventors: Sandor Einstein, Denville, NJ (US); Adriana Eng, Randolph, NJ (US); Donald Chiu, Fresh Meadow, NY (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 732 days.

(21) Appl. No.: 11/306,927

(22) Filed: Jan. 17, 2006

Related U.S. Application Data

(63) Continuation-in-part of application No. 10/248,667, filed on Feb. 6, 2003, now abandoned.

(60) Provisional application No. 60/355,995, filed on Feb. 8, 2002.

(51) Int. Cl.
*F42B 5/38* (2006.01)
*F42B 5/08* (2006.01)

(52) U.S. Cl. ..... 102/443

(58) Field of Classification Search ..... 102/443
See application file for complete search history.

(56) References Cited

U.S. PATENT DOCUMENTS

| | | | | | |
|---|---|---|---|---|---|
| 547,222 | A * | 10/1895 | Maxim | ..... | 102/443 |
| 4,581,998 | A * | 4/1986 | Horst et al. | ..... | 102/289 |
| 5,160,804 | A * | 11/1992 | Wahner et al. | ..... | 102/443 |
| 5,335,599 | A * | 8/1994 | Thiesen et al. | ..... | 102/431 |
| 6,167,810 | B1 * | 1/2001 | Isle et al. | ..... | 102/443 |

* cited by examiner

*Primary Examiner*—Stephen M Johnson
(74) *Attorney, Agent, or Firm*—Michael C. Sachs

(57) ABSTRACT

A modular propellant charge for semi-fixed ammunition is disclosed. The propellant charge is disposed within an ammunition cartridge canister, and permits direct access to each charge increment. Further, the propellant charge comprises at least one charge increment comprising a rigid section of a cylindrical solid of rotation, and each charge increment has a length less than the central cavity of said ammunition canister.

1 Claim, 4 Drawing Sheets

AXIAL MODULAR PROPULSION CHARGE DESIGN FOR SEMI-FIXED AMMUNITION

CROSS REFERENCE TO RELATED APPLICATIONS

This application is a continuation-in-part of application Ser. No. 10/248,667 filed Feb. 6, 2003, now abandoned which itself claims benefit under 35 USC 119(e) of Patent Application No. 60/355,995, filed Feb. 8, 2002, the entire file wrapper contents of all of which applications are hereby incorporated by reference as though fully set forth.

FEDERAL RESEARCH STATEMENT

[The invention described herein may be made, used, or licensed by or for the United States Government for Government purposes without the payment of any royalties thereon or therefore.]

BACKGROUND OF INVENTION

1. Field of the Invention

The present invention relates to semi-fixed ammunition. In particular, the present invention relates to semi-fixed ammunition and is intended to replace the cumbersome, multi-zone, bagged discrete charge system with charge components of a rigid, modular design.

2. Description of Related Art

Historically, the United States military has maintained 105 mm howitzers, which employ semi-fixed ammunition. Semi-fixed ammunition is a design where the projectile is seated on a cartridge canister or case containing a propulsion system. The term "semi-fixed" means that the projectile can be removed from the case mouth and replaced there, permitting access to the internal propellant charge. When ammunition of this type is employed, it is typically used in a multi-zone configuration. In this mode, the projectile is removed and the propellant charge adjusted by removal of one or more of the propellant increments, then the projectile is reseated on the case mouth. The complete round, prepared in this manner, is then inserted into the cannon for firing. In the present generation of howitzers with semi-fixed ammunition, all systems currently employ a plurality of cloth bags to hold the propellant. Zoning is achieved by removing one or more of these bags.

While this system has proven useful over the years, it is not without its limitations. Firstly, it is not a system, which can be easily automated, and its rate of fire cannot be increased. Further, there are safety issues associated with the misidentification of charge increments, and deterioration of the cloth bags employed, during long-term storage, has traditionally been a problem. It has recently been determined that, because of the shape and location of the ullage, or empty space within the cartridge canister, internal pressure waves can occur, which can cause adverse, sometimes catastrophic, ignition.

U.S. Pat. Nos. 4,702,167 and 4,864,932 to Reinelt and Schwenzer are entitled Propellant-Charge Module and are assigned to Rheinmetall GmbH, of Germany. These references both claim priority of a single German patent filing, and show a propellant-charge pack of the doughnut-shaped annular type, in which the inner annular wall is provided with an easily ignited primary charge, while the remaining volume of the pack contains propellant.

U.S. Pat. No. 5,180,883 to Jaskolka, Rahnenfuhrer and Schulze, is entitled Ammunition and is assigned to Theinmetall GmbH, of Germany. This reference shows a projectile with primary charge and a projectile charge. In addition, both of these charges are provided with an annular transfer charge at their junctions that permits ignition of the projectile charge without a noticeable time delay relative to the primary charge.

U.S. Pat. No. 5,844,163 to Lindskog, is entitled Loading System and is assigned to Bofors AB, of Sweden. This reference shows a method and device for the automatic loading of doughnut-shaped rigid propellant modules. A stack of the chosen loading modules is prepared and swung into position to be ram-loaded.

BRIEF SUMMARY OF INVENTION

Objects of the Invention

It is an object of the present invention to provide charge increments for semi-fixed ammunition, which can be more easily automated.

It is a further object of the present invention to provide charge increments for semi-fixed ammunition, which can provide a more rapid rate of fire.

It is a still further object of the present invention to provide charge increments for semi-fixed ammunition, which can be more easily identified.

It is another object of the present invention to provide charge increments for semi-fixed ammunition, which can be removed directly.

It is another object of the present invention to provide charge increments, which do not require the use of cloth bags.

It is another object of the present invention to provide charge increments, which reduce the danger of internal pressure waves.

The other objects, features and advantages of the present invention will become more apparent in light of the following detailed description of the preferred embodiment thereof.

SUMMARY OF INVENTION

In the present invention, there is provided a modular propellant charge for semi-fixed ammunition in a multi-zone configuration, said ammunition comprising:

a demountable projectile;

an elongated cylindrical cartridge canister comprising:

at a first end thereof, ignition means;

a central cylindrical body portion having a hollow inner chamber of fixed inner diameter, said body portion further comprising:

a primary initiator in operative engagement with said ignition means at said first end thereof; and, a propellant charge comprising a plurality of charge increments disposed within said hollow inner chamber; and, a second open end thereof, having said demountable projectile attached thereto;

wherein said demountable projectile may be removed, permitting access through said open second end of said elongated cylindrical cartridge canister and enabling a selection of said charge increments to be used in said semi-fixed ammunition in a multi-zone configuration, and further comprises the employment of charge elements of said propellant charge in which at least one is a rigid section of a cylindrical solid of rotation, having a length less than the length of said central cylindrical body portion of said elongated cylindrical cartridge canister of said ammunition, and the length of each charge increment enables it to be directly accessible through said open end of said canister.

In another aspect of the present invention, there is provided a modular propellant charge for semi-fixed ammunition in a multi-zone configuration, said ammunition comprising:

a demountable projectile;

an elongated cylindrical cartridge canister comprising:

at a first end thereof, ignition means;

a central cylindrical body portion having a hollow inner chamber of fixed inner diameter, said body portion further comprising:

a primary initiator in operative engagement with said ignition means at said first end thereof; and, a propellant charge comprising a plurality of charge increments disposed within said hollow inner chamber; and, a second open end thereof, having said demountable projectile attached thereto;

wherein said demountable projectile may be removed, permitting access through said open second end of said elongated cylindrical cartridge canister to provide a selection of said charge increments to be used in said semi-fixed ammunition in a multi-zone configuration, and further comprises the employment of charge elements of said propellant charge in which at least one is a rigid section of a cylindrical solid of rotation, having a length less than the length of said central cylindrical body portion of said elongated cylindrical cartridge canister of said ammunition, and the length of each charge increment enables it to be directly accessible through said open end of said canister.

In another aspect of the present invention, there is provided a modular propellant charge for semi-fixed ammunition in a multi-zone configuration, said ammunition comprising:

a demountable projectile;

an elongated cylindrical cartridge canister comprising:

at a first end thereof, ignition means;

a central cylindrical body portion having a hollow inner chamber of fixed inner diameter, said body portion further comprising:

a primary initiator in operative engagement with said ignition means at said first end thereof; and, a propellant charge comprising a plurality of charge increments disposed within said hollow inner chamber; and, a second open end thereof, having said demountable projectile attached thereto;

wherein said demountable projectile wherein said demountable projectile may be removed, permitting access through said open second end of said elongated cylindrical cartridge canister and to provide a selection of said charge increments enabling its use in said semi-fixed ammunition in a multi-zone configuration, and further comprises the employment of charge elements of said propellant charge in which at least one is a rigid section of a cylindrical solid of rotation, having a length less than the length of said central cylindrical body portion of said elongated cylindrical cartridge canister of said ammunition, and the length of each charge increment enables it to be directly accessible through said open end of said canister.

DETAILED DESCRIPTION

According to the present invention, there is provided a modular propellant charge for semi-fixed ammunition in a multi-zone configuration. This ammunition comprises a demountable projectile mounted on an elongated cylindrical cartridge canister. The canister comprises, at a first end thereof, ignition means, a central cylindrical body portion having a hollow inner chamber of fixed inner diameter, and a second open end, having the demountable projectile attached thereto. The cylindrical body portion comprises a primary initiator in operative engagement with the ignition means at the first end of the canister, and a propellant charge which itself comprises a plurality of charge increments disposed within the hollow inner chamber.

In use, the demountable projectile may be removed, permitting access to said propellant charge through the open second end of the elongated cylindrical cartridge canister. Selection may be made of the charge increments to enable use of said semi-fixed ammunition in a multi-zone configuration.

In the present invention, the improvement comprises the employment of charge elements for the propellant charge in which at least one is a rigid section of a cylindrical solid of rotation, having a length less than the length of the central cylindrical body portion of the elongated cylindrical cartridge canister of said ammunition. Such a charge increment is directly accessible through said open end of the canister.

Figure 1:
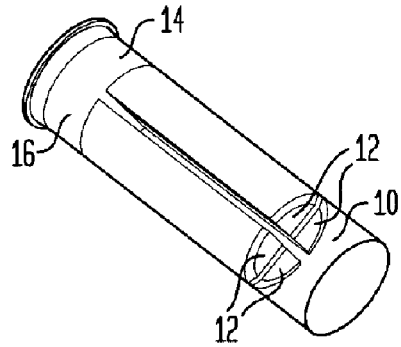
FIG. 1 shows an embodiment of the present invention, which comprises a grouping of pie-shaped charge increments and a base charge/primer increment at the first end of the cartridge.

FIG. 1 shows an embodiment of the present invention 10, which comprises a grouping of pie-shaped charge increments 12 and a base charge increment 14 and primer 76 at the first end of the cartridge.

Figure 2:
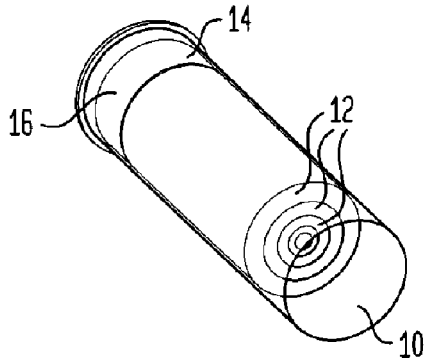
FIG. 2 shows an embodiment of the present invention, which comprises a grouping of concentric cylindrical charge increments and a base charge/primer increment at the first end of the cartridge.

FIG. 2 shows an embodiment of the present invention 10, which comprises a grouping of concentric cylindrical charge increments 12 and a base charge increment 14 and primer 16 at the first end of the cartridge.

Figure 3:
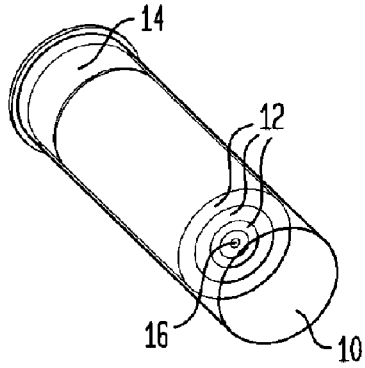
FIG. 3 shows an embodiment of the present invention, which comprises a grouping of concentric cylindrical charge increments, a base charge increment at the first end of the cartridge, and a central primer.

FIG. 3 shows an embodiment of the present invention 10 which comprises a grouping of concentric cylindrical charge increments 12, a base charge increment 14 at the first end of the cartridge, and a central primer 16.

Figure 4:
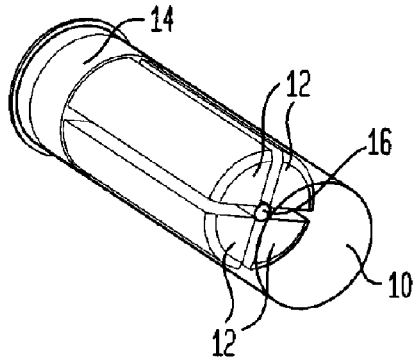
FIG. 4 shows an embodiment of the present invention, which comprises a grouping of pie-shaped charge increments, a base charge increment at the first end of the cartridge, and a central primer.

FIG. 4 shows an embodiment of the present invention 10 which comprises a grouping of pie-shaped charge increments 12, a base charge increment 74 at the first end of the cartridge, and a central primer 16.

Figure 5:
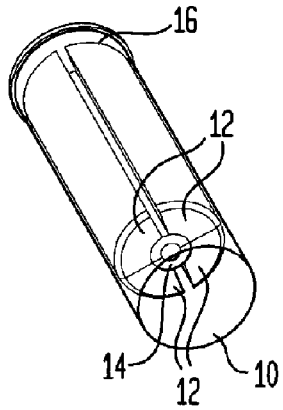
FIG. 5 shows an embodiment of the present invention, which comprises a grouping of pie-shaped charge increments, a primer at the first end of the cartridge, and a central base charge increment.

FIG. 5 shows an embodiment of the present invention 10, which comprises a grouping of pie-shaped charge increments 12, a primer 76 at the first end of the cartridge, and a central base charge increment 14.

Figure 6:
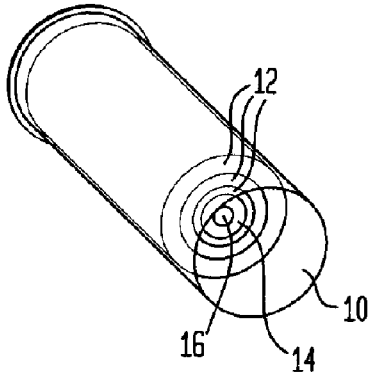
FIG. 6 shows an embodiment of the present invention, which comprises a grouping of concentric cylindrical charge increments, a central primer, and a central, cylindrical base charge increment.

FIG. 6 shows an embodiment of the present invention 10, which comprises a grouping of concentric cylindrical charge increments 12, a central primer 16, and a central, cylindrical base charge increment 14.

Figure 7:
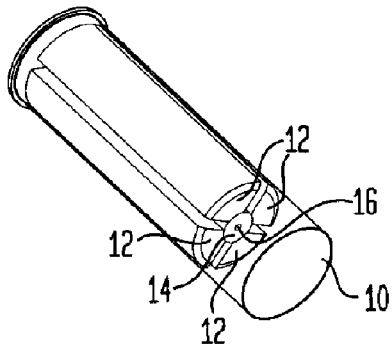
FIG. 7 shows an embodiment of the present invention, which comprises a grouping of pie-shaped charge increments, a central primer, and a central, cylindrical base charge increment.

FIG. 7 shows an embodiment of the present invention 10, which comprises a grouping of pie-shaped charge increments 12, a central primer 16, and a central, cylindrical base charge increment 14.

Figure 8:
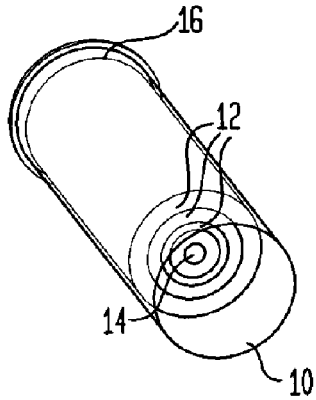
FIG. 8 shows an embodiment of the present invention, which comprises a grouping of concentric cylindrical charge increments, a primer at the first end of the cartridge, and a central, cylindrical base charge element.

FIG. 8 shows an embodiment of the present invention 10, which comprises a grouping of concentric cylindrical charge increments 12, a primer 76 at the first end of the cartridge, and a central, cylindrical base charge element 14.

Figure 9:
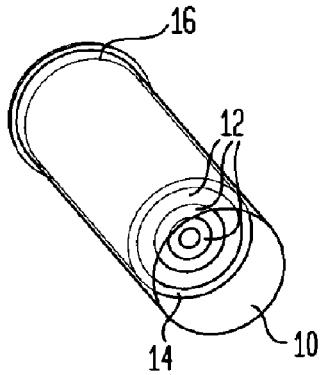
FIG. 9 shows an embodiment of the present invention, which comprises a grouping of concentric cylindrical charge increments, a primer at the first end of the cartridge, and an outer, cylindrical base charge increment.

FIG. 9 shows an embodiment of the present invention 10 which comprises a grouping of concentric cylindrical charge increments 12, a primer 76 at the first end of the cartridge, and an outer, cylindrical base charge increment 14.

Figure 10:
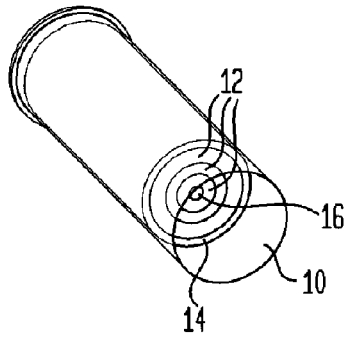
FIG. 10 shows an embodiment of the present invention, which comprises a grouping of concentric cylindrical charge increments, a central primer, and an outer, cylindrical base charge increment.

FIG. 10 shows an embodiment of the present invention 10, which comprises a grouping of concentric cylindrical charge increments 12, a central primer 16, and an outer, cylindrical base charge increment 14.

Figure 11:
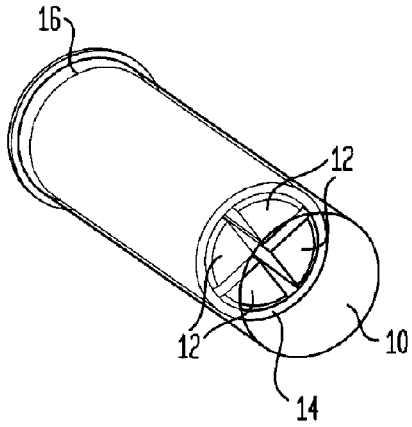
FIG. 11 shows an embodiment of the present invention, which comprises a grouping of pie-shaped charge increments, a primer at the first end of the cartridge, and an outer, cylindrical base charge increment.

FIG. 11 shows an embodiment of the present invention 10 which comprises a grouping of pie-shaped charge increments 12, a primer 76 at the first end of the cartridge, and an outer, cylindrical base charge increment 14.

Figure 12:
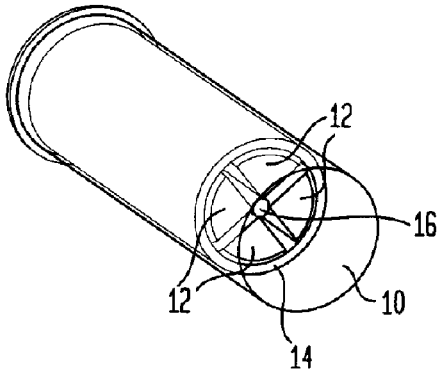
FIG. 12 shows an embodiment of the present invention, which comprises a grouping of pie-shaped charge increments, a central primer, and an outer, cylindrical base charge increment.

FIG. 12 shows an embodiment of the present invention 10, which comprises a grouping of pie-shaped charge increments 12, a central primer 16, and an outer, cylindrical base charge increment 14.

The present invention discloses a system wherein all the propellant is contained in a rigid container or formed into a rigid body, which will assist in the automated manufacture of the charge increments and avoid the problems of cloth deterioration common to the cloth-bagged increment system of the prior art. Reapportioning the propellant and re-zoning the ballistic solution into a minimum number of discrete modules will resolve the misidentification problems and increase the potential for faster rates of fire. To date, however, the solutions proposed have been to design the individual propellant charge increments in the form of a doughnut to stack upon each other around a central primer. Such designs would use modules of the same inner and outer diameter with; possibly, different thicknesses to reflect to different masses of propellant in different charge increments. Since the cartridge case mouth has a restricted diameter and a central primer, the increments would have to be dumped out and reinserted because only the uppermost increments could be accessed directly. Further, it has been determined that this design, like the loose bags that precedes it, can be conducive to the generation of a significant pressure wave within the chamber during the ignition phase of the combustion process.

And alternative design for a modular propulsion system is to orient the increments axially. This concept has multifaceted improvements over the doughnut-shaped design concept and yet still utilizes rigid modules to permit multi-zone use. With this design, the ends of all charge increments remain accessible at the open end of the cartridge canister, facilitating the preparation for firing and increasing the potential for rate-of-fire increases. Secondly, when such a modular charge increment is removed, the ullage is longitudinally distributed through the remaining propellant, extending the length of the cartridge canister, and mitigating the generation of significant pressure waves.

In a bi-modular design, it might be desirable to configure an initial charge increment, which would be present at all times, as a fixed, short cylinder positioned at the base of the cartridge case, or a fixed rod or annulus along the centerline of the cartridge canister. This would further facilitate the use of a modular system of charge increments since only one type module will need to be removed for zoning use.

Other features, advantages, and specific embodiments of this invention will become readily apparent to those exercising ordinary skill in the art after reading the foregoing disclosures. These specific embodiments are within the scope of the claimed subject matter unless otherwise expressly indicated to the contrary. Moreover, while specific embodiments of this invention have been described in considerable detail, variations and modifications of these embodiments can be effected without departing from the spirit and scope of this invention as disclosed and claimed.

What is claimed is:

1. A modular propellant charge for semi-fixed ammunition in a multi-zone configuration, said ammunition comprising a demountable projectile, an elongated cylindrical cartridge canister comprising, at a first end thereof, and a means for ignition, a central cylindrical body portion having a hollow inner chamber of fixed inner diameter, said body portion further comprising, a primary initiator in operative engagement with said means for ignition at said first end thereof, and a propellant charge comprising a plurality of charge increments disposed within said hollow inner chamber; and wherein said ignition means is used to ignite the propellant charge, a second open end thereof, having said demountable projectile attached thereto; wherein said demountable projectile may be removed, permitting access to said propellant charge through said open second end of said elongated cylindrical cartridge canister and selection of said charge increments to enable use of said semi-fixed ammunition in a multi-zone configuration, said ammunition employing no other propellant as a charge thereof but said modular propellant charge, said modular propellant charge further comprising charge elements having a length less than the length of said ammunition to enable removal or insertion of charge elements there within to function said semi-fixed ammunition to operate in multiple zones, and wherein at least one of said modular propellant charge elements is a pie-shaped section of a cylindrical solid of rotation.

* * * * *